US008324534B2

(12) United States Patent
Shrewsbury et al.

(10) Patent No.: US 8,324,534 B2
(45) Date of Patent: Dec. 4, 2012

(54) HEATING IRON CASE

(75) Inventors: Polly J. Shrewsbury, Austin, TX (US); Judy S. Im, Austin, TX (US); Greg S. Hinzmann, Beaverton, OR (US)

(73) Assignee: Pollyseon, LLC, Austin, TX (US)

( * ) Notice: Subject to any disclaimer, the term of this patent is extended or adjusted under 35 U.S.C. 154(b) by 406 days.

(21) Appl. No.: 12/766,851

(22) Filed: Apr. 23, 2010

(65) Prior Publication Data

US 2011/0259868 A1 Oct. 27, 2011

(51) Int. Cl.
*H05B 3/06* (2006.01)

(52) U.S. Cl. ..... 219/242; 190/110; 383/61.3

(58) Field of Classification Search ..... 219/226, 219/229, 242; 383/61.1, 61.3
See application file for complete search history.

(56) References Cited

U.S. PATENT DOCUMENTS 4,570,792 A * 2/1986 Conway ..... 206/349
5,577,607 A * 11/1996 Drake et al. ..... 206/349
5,638,955 A * 6/1997 Calciano ..... 206/320
5,950,826 A * 9/1999 Lykowski ..... 206/349
2003/0062278 A1* 4/2003 Bean ..... 206/349
2005/0224305 A1* 10/2005 Davis ..... 190/113
2007/0284272 A1* 12/2007 Rosdal ..... 206/349
2009/0173648 A1* 7/2009 Geneva ..... 206/320

OTHER PUBLICATIONS

Style Bell Website, http://www.stylebell.com/Flat-Iron-Cleaners-s/315.htm (captured May 31, 2010).
Baggallini Website, http://www.baggallini.com/collections.asp?collection='jca' (captured May 31, 2010).
Misikko Website, http://www.misikko.com/best-flat-iron.html (captured May 31, 2010).

* cited by examiner

*Primary Examiner* — Stephen W Smoot
(74) *Attorney, Agent, or Firm* — Witkowski Law

(57) ABSTRACT

A case for holding an iron having a heating element coupled to a handle, the handle coupled to an electrical cord having a plug, the apparatus comprising: a sleeve having an opening for receiving the heating element; a pair of flaps each coupled to the surface of the sleeve, the flaps forming a cavity from one portion of the perimeter of the opening to another portion of the perimeter of the opening, the cavity being such that the electrical cord can be wrapped around the sleeve and secured by removably coupling the flaps around the electrical cord.

10 Claims, 4 Drawing Sheets

HEATING IRON CASE

BACKGROUND

1. Technical Field

This disclosure relates generally to the field of cases. More particularly, the disclosure relates to heating iron cases for storage, transport and display of hair styling and other cosmetology equipment.

2. Background Art

Professional hair stylists spend significant sums of money on their cosmetology equipment. They frequently carry this expensive equipment around. Independent stylists generally bring their cosmetology equipment to and from their client's work sites each day. Even stylists who work at a station in a salon generally carry their equipment back and forth each day because they do not want to leave their expensive equipment at the salon overnight.

Some stylists use a gym bag to carry their equipment. Gym bags generally do not have sufficient cushioning to protect the individual pieces from each other and from external impact. Additionally, bags generally do not have sufficient partitioning to allow for organization of the equipment for easy storage and retrieval. Furthermore, gym bags do not project the professional and sophisticated image that cosmetologists generally want to convey to their clientele.

It is desirable for heating iron cases to provide convenient transportation of cosmetology equipment, efficient access to that equipment, and protection of that equipment from damage or breakage.

SUMMARY

A case for holding an iron having a heating element coupled to a handle, the handle coupled to an electrical cord having a plug, the apparatus comprising: a sleeve having an opening for receiving the heating element; a pair of flaps each coupled to a surface of the sleeve, the flaps forming a cavity from one portion of the perimeter of the opening to another portion of the perimeter of the opening, the cavity being such that the electrical cord can be wrapped around the sleeve and secured by removably coupling the flaps around the electrical cord.

DETAILED DESCRIPTION

Various examples of embodiments of a heating iron case will be described below with reference to the drawings. These exemplary embodiments are illustrative and are not to be construed as limiting.

In some embodiments, the heating iron case is adapted to be used in at least two configurations. In a first configuration, the heating iron case contains and protects the contents for storage or transport. In a second configuration, the heating iron case provides a surface that can be used to lay a hot iron on. The illustrated embodiments of the heating iron case are described with reference to contents that include a flat iron for professional hair stylists. It will be apparent to one skilled in the art that the heating iron case can be adapted to store other heating devices, such as heating irons of other shapes and sizes. In other embodiments, the heating iron case may be adapted to store other contents and can be used for other personal and professional applications.

Figure 1:
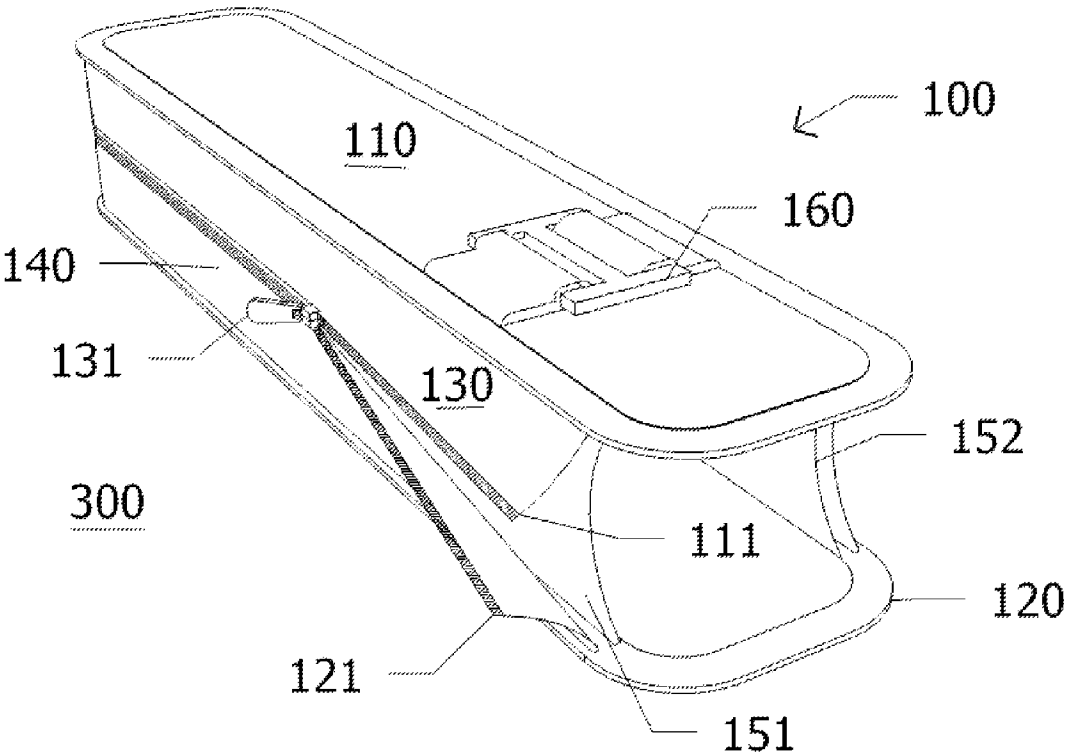
FIG. 1 illustrates one embodiment of a heating iron case from one viewpoint.

FIG. 1 illustrates one embodiment of a heating iron case 100. The heating iron case 100 is approximately 3 inches square by 14 inches long. A panel 110 is sewn to a side panel 151, a side panel 152 and a back panel (not shown) that form the inner sides of the heating iron case 100. A panel 120 is sewn to the side panel 151, the side panel 152 and the back panel (not shown) to form a sleeve in which a heating iron may be inserted. The heating iron case 100 includes an ornamental buckle 160 on the panel 110.

The panel 110 and the panel 120 have an inner shell and an outer shell enclosing a foam layer. The foam layer provides some protection to a heating iron inserted into the sleeve. The inner shells of the panel 110 and the panel 120, along with side panels 151 and 152, are formed of a heat-resistant material.

A flap 130 is attached at one end along the perimeter of the panel 110. Zipper teeth 111 are coupled to the opposite end of the flap 110. A flap 140 is attached at one end along the perimeter of one of the panel 120. Zipper teeth 121 are coupled to the opposite end of the flap 120. A zipper slider 131 is used to join the zipper teeth 111 and the zipper teeth 112 to enclose a cavity around the sleeve running along the side and back panels from an area adjacent to one portion of the perimeter of the opening of the sleeve to an area adjacent to another portion of the perimeter of the opening of the sleeve.

Figure 2:
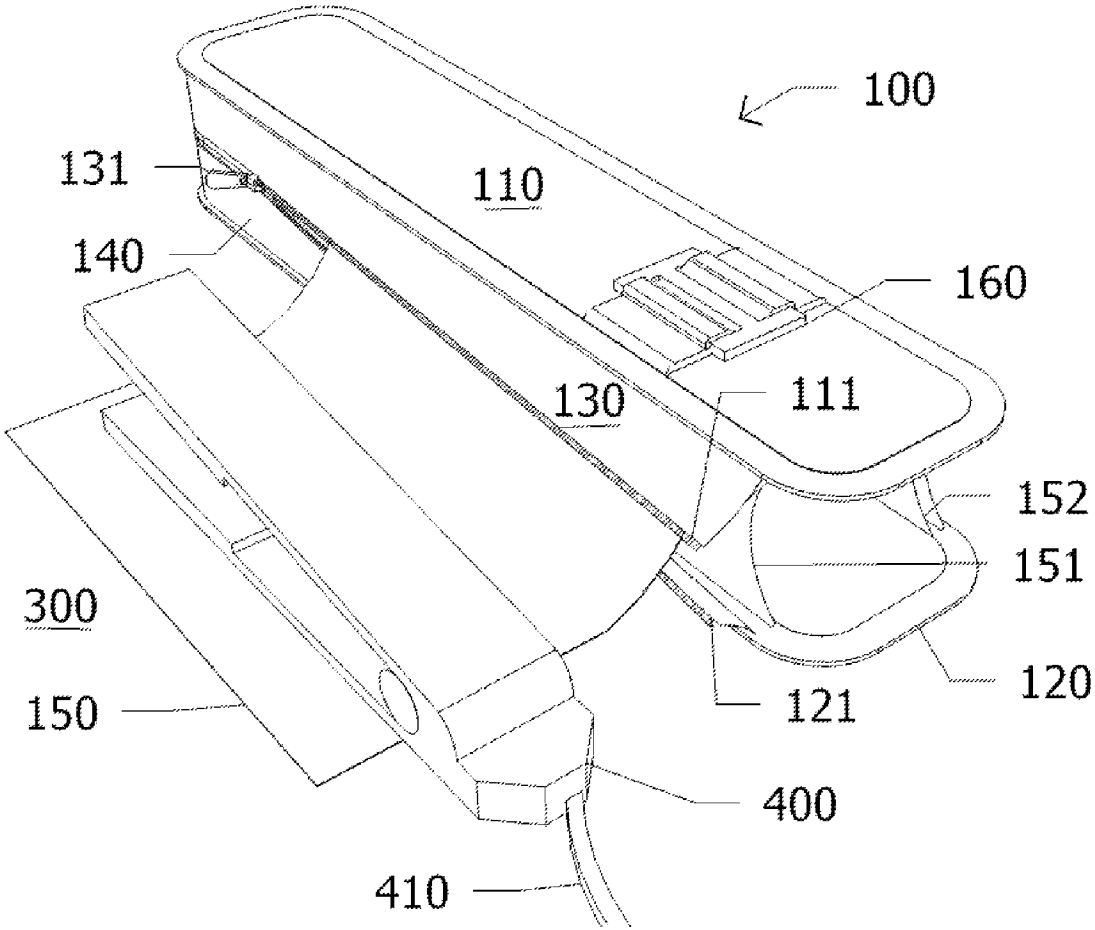
FIG. 2 illustrates one embodiment of the heating iron case from another viewpoint.

FIG. 2 illustrates one embodiment of the heating iron case with a heat-resistant sheet 150 laid out on a surface 300. The heat-resistant sheet 150 is coupled to the perimeter of the panel 110. When not in use the heat-resistant sheet 150 is rolled up and enclosed in the cavity around the sleeve. The zipper slider 131 is slid to uncouple the flap 130 from the flap 140 so that the heat-resistant sheet 150 can be removed. When in use, the heat-resistant sheet 150 is laid flat on a surface 300 such that a hot heating iron 400 can be placed on it. The heat-resistant sheet 150 protects the underlying surface 300 from heat damage caused by the hot heating iron 400 when it is put aside during use by a hair stylist.

The heat-resistant sheet 150 is approximately 12 inches long and 10 inches wide. In one embodiment, the heat-resistant sheet 150 is made of a fiberglass material that is heat-resistant up to 1100 degrees Fahrenheit (approximately 600 degrees Celsius). This protects surfaces against heating irons, which typically reaches temperatures between 300 and 450 degrees Fahrenheit.

Figure 3:
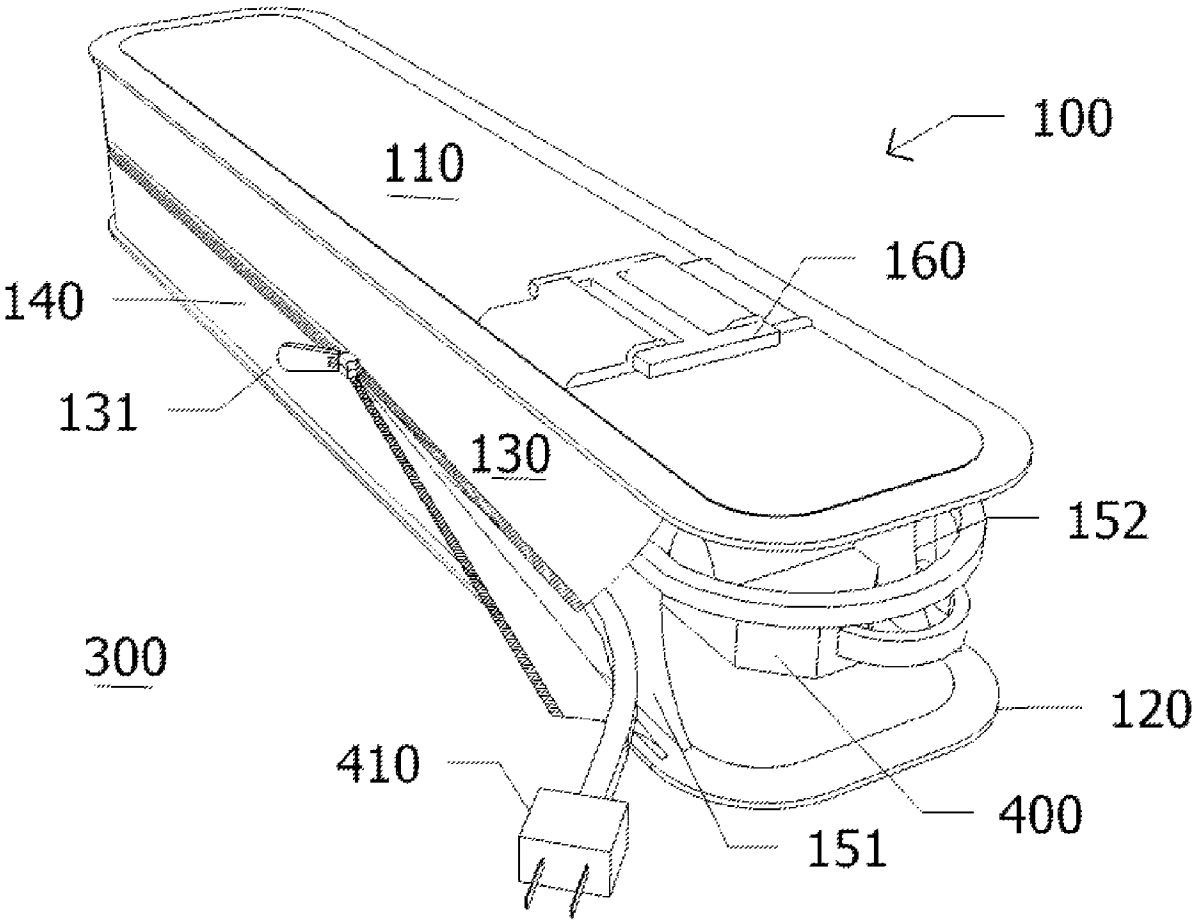
FIG. 3 illustrates one embodiment of the heating iron case with a sheet.

FIG. 3 illustrates the heating iron case with the heating iron 400 inserted into the sleeve. The heating iron 400 includes an electrical cord 410. The electrical cord 410 wraps around the cavity twice. The zipper slider 131 removably couples the flap 130 to the flap 140. Thus, the electrical cord 410 is held in place in the cavity between the flap 130 and the flap 140 and the side panel 151 and the side panel 152 and back panel (not shown). This prevents the electrical cord 410 from getting tangled up with other equipment. This configuration allows the heating iron case 100 to transport a heating iron 400.

Figure 4:
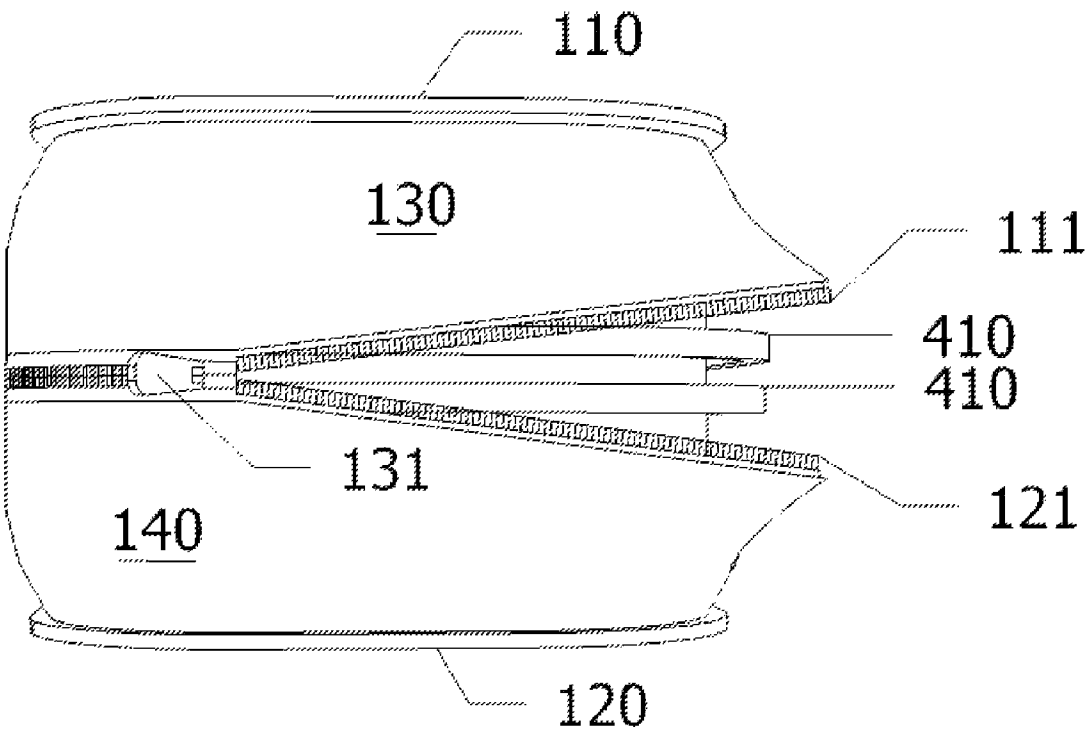
FIG. 4 illustrates one embodiment of the heating iron case with a flat iron.

FIG. 4 illustrates one embodiment of the heating iron case 100 from a rear view. The flap 130 is coupled to the perimeter of the panel 110. The flap 140 is coupled to the perimeter of the panel 120. The zipper teeth 111 and the zipper teeth 121 are coupled by the zipper slider 151 on the left side and uncoupled on the right side such that the flap 130 and the flap

140 are separated on the right side to expose the electrical cord 410 wrapped around the cavity twice. When the zipper slider 151 is used to couple the zipper teeth 111 and the zipper teeth 121 along the whole length of the flap 130 and the flap 140, the electrical cord 410 is enclosed in the cavity underneath the flap 130 and the flap 140. It will be apparent to one skilled in the art that the cavity can be sized to hold cords of different sizes and cords that have a length that requires it be wrapped around the cavity more or less than two times. It will be apparent to one skilled in the art that the embodiments are not limited to storing heating irons. For example, other corded equipment can be inserted into a sleeve of suitable size and shape.

The above description introduces numerous specific details, such as measurements and materials, to provide a thorough understanding of, and enabling description for, the illustrated embodiments of the heating iron case 100. One skilled in the art will recognize that these embodiments can be practiced without one or more of these specific details, or with other components. In some instances well known components are not described in detail to avoid obscuring aspects of the disclosed embodiments.

What is claimed is:

1. A case for holding an iron, the iron having a heating element coupled to an electrical cord, the case comprising:

a sleeve having an opening for receiving the heating element, the sleeve having a surface;

a pair of flaps each coupled to the surface of the sleeve, the flaps being configured to form a cavity by removably coupling the flaps to each other whereby the heating element can be inserted into the sleeve, the electrical cord can be wrapped around the sleeve and the flaps can be removably coupled around the electrical cord.

2. The case of claim 1 wherein the sleeve comprises a heat resistant material.

3. The case of claim 1 wherein the flaps are large enough to secure the electrical cord wrapped around the sleeve at least two times.

4. The case of claim 1 wherein the pair of flaps are removably coupled to each other with a zipper.

5. The case of claim 1 further comprising a sheet of heat resistant material coupled to the surface of the sleeve between the pair of flaps, the cavity being large enough to contain the sheet and electrical cord by removably coupling the flaps around the electrical cord and the sheet.

6. The case of claim 1 wherein the cavity is formed from one portion of the perimeter of the opening to another portion of the perimeter of the opening.

7. The case of claim 1 wherein the sleeve comprises at least one panel.

8. The case of claim 7 wherein the surface extends over the panel.

9. The case of claim 7 wherein the panel encloses a foam layer.

10. The case of claim 7 wherein the panel comprises a heat resistant material.

* * * * *